United States Patent [19]

Meisner et al.

[11] Patent Number: 4,749,874

[45] Date of Patent: Jun. 7, 1988

[54] ELECTRONIC TIMER

[75] Inventors: Alfred Meisner; Werner Arnold, both of Nuremberg; Tilmann Kruger, Neunkirchen, all of Fed. Rep. of Germany

[73] Assignee: DIEHL GmbH & Co., Nuremberg, Fed. Rep. of Germany

[21] Appl. No.: 62,353

[22] Filed: Jun. 11, 1987

Related U.S. Application Data

[63] Continuation of Ser. No. 805,580, Apr. 24, 1987, abandoned, which is a continuation of Ser. No. 616,485, Jun. 1, 1984, abandoned.

[30] Foreign Application Priority Data

Jun. 3, 1983 [DE] Fed. Rep. of Germany ..... 3320128

[51] Int. Cl.[4] ..... H01H 3/34

[52] U.S. Cl. ..... 307/141.4; 307/141.8; 340/825.22

[58] Field of Search ..... 307/141, 141.4, 141.8, 307/140, 139; 340/365 R, 309.4, 309.5, 825.22

[56] References Cited

U.S. PATENT DOCUMENTS 4,228,543 10/1980 Jackson ..... 340/309.15 X 4,570,216 2/1986 Chan ..... 307/141.8 X

*Primary Examiner*—A. D. Pellinen

*Assistant Examiner*—Todd E. DeBoer

*Attorney, Agent, or Firm*—Scully, Scott, Murphy & Presser

[57] ABSTRACT

An electronic timer, preferably a kitchen range timer, which includes a control circuit, a display area, input elements, and a switching arrangement which selectively connects an appliance (auto mode) which is operable through the timer directly with a current supply (manual mode). The control circuit is switched into the auto mode through the input of at least one complete switching term, whereby after traversing of the switching terms in the control circuit, the latter is switched into a wait-mode, wherein the appliance which is already separated from the current supply, remains separated from the current supply, and wherein the control circuit which is connected in the wait-mode is switched back into the manual-mode upon the actuation of the manual input element which is provided for this purpose.

5 Claims, 2 Drawing Sheets

ELECTRONIC TIMER

This application is a continuation, of application Ser. No. 805,580, filed Apr. 24, 1987, now abandoned which is a continuation application of Ser. No. 616,485, filed June 1, 1984, now abandoned.

BACKGROUND OF THE INVENTION

1. Field of the Invention

The present invention relates to an electronic timer, preferably a kitchen range timer which includes a control circuit, a display area, input elements, and a switching arrangement which selectively connects an appliance (auto mode) which is operable through the timer directly with a current supply (manual mode).

2. Discussion of the Prior Art

Timers of the foregoing type are currently known and commercially marketed. Thus, for example, an electronic kitchen range timer, which is commercially sold by the present applicants under the registered trademark "ORBITRON" evidences a display area on the front side thereof, below which there are located input elements. Hereby, the input elements consists of a plurality of push-buttons, as well as a manually rotatable pulse generator and a rotary switch. Thereby, switching terms are introduced through depression of the applicable push-button and through the concurrent rotation or turning of the pulse generator. The rotary switch incorporates two different switch positions, in which the kitchen range timer is switched to either "auto" or "manual". Thereby, the program (consisting of the introduced switching terms) is only effective for an appliance which is operated through the timers, when the rotary switch is switched into the position "auto". In the "hand" position of the rotary switch, the timer is bypassed and the appliance is connected directly to the current supply; in essence, the appliance (for example, power regulation in a kitchen range) can be "manually" switched on and off. During the practical operation of a kitchen range with a timer of that type there, during operation through the timer, there must be introduced a program of switching terms, for instance, cooking beginning in cooking end, and either previously thereto or subsequently thereto, the rotary switch must be set to "auto".

When the desired cooking plate is thereafter switched on, then only upon the introduced cooking beginning will be connected with the current supply. However, if one omits to set the rotary switch to "auto", then the cooking plate is immediately placed into operation and also will no longer be switched off, so as to possibly lead to an overheating of the cooking plates, destruction of the cooking ingredients, and so forth.

When, in connection with an input sequence, the rotary switch is actuated in the correct mode, then the program will run correctly; however, thereafter the rotary switch must be reset into the position "manual". When this is omitted, then the operation of the appliance is blocked "by hand", which can lead to the erroneous assumption that the appliance is defective.

SUMMARY OF THE INVENTION

Accordingly, it is an object of the present invention to provide an arrangement which will simplify the operation of that type of electronic timer and furthermore, to reduce the possibility of erroneous operation which could occasion damages.

In accordance with particular features of the inventive electronic timer of the above-mentioned type, the foregoing object is readily achieved in that the control circuit is switched into the auto mode through the input of at least one complete switching term, whereby after traversing of the switching terms in the control circuit, the latter is switched into a wait-mode, wherein the appliance which is already separated from the current supply, remains separated from the current supply, and wherein the control circuit which is connected in the wait-mode is switched back into the manual-mode upon the actuation of the manual input element which is provided for this purpose.

Hereby, there is effected the automatic switching over from the manual-mode ("hand") into the auto-mode ("auto") with the input of a first switching term, without necessitating the actuation of a change-over switch. The foregoing will render it impossible, that notwithstanding the programming of the timer, that an appliance which is operable through this timer is immediately connected with the current supply, and no longer for example, is switched off too late.

In particular, the manual-input element can be so constructed that, upon an actuation during the auto-mode of the timer, it will similarly switch back into the manual-mode, whereby there are concurrently erased the switching terms introduced heretofore. In this advantageous embodiment, the manual-input element is thus utilizable for the rapid erasing or obliterating of erroneously introduced switching terms.

Through the combination of the manual-input element with an optically visible indicator, which preferably blinks during the wait-mode, there is readily ensured an easy recognition of the wait-mode by the user so as to appreciably reduce the probability of an erroneous operation.

BRIEF DESCRIPTION OF THE DRAWINGS

Further advantageous features embodiments of the invention can now be ascertained from the following detailed description, taken in conjunction with the accompanying drawings; in which.

DETAILED DESCRIPTION

Figure 1:
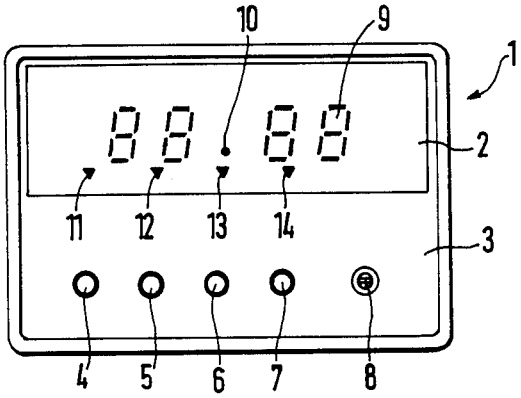
FIG. 1 illustrates an example of a front view of an electronic timer.

Referring now in detail to the drawings, FIG. 1 illustrates the front view of an electronic timer 1 with a display area or field 2 and an operating area or field 3. The operating field 3 preferably incorporates four push-buttons 4, 5, 6 and 7, and a turn-knob 8 for a manually-actuatable pulse generator. The display field 2 preferably incorporates a four-position seven-segment representation 9 for the display of hours and minutes (clock time, or respectively switching terms), with a separating point 10 or the like (double point, dashline) located between hours and minutes.

Furthermore, the display field 2 preferably possesses four optically visible indicators 11, 12, 13 and 14, which are preferably so arranged as to be located in the display field 2 directly above the four push-buttons 4, 5, 6 and 7, and thereby spatially associated with the latter. These indicators 11, 12, 13 and 14 perferably evidence at least partially, for display areas with active displays (for instance, fluorescent or LED displays), three different display conditions:

(a) continuously illuminated (b) blinking (c) continuously unilluminated

Naturally, through the use of other display types there can be provided other display possibilities in an equivalent manner. Furthermore, it is possible to provide additional display elements in the display field 2, which preferably serve for the guidance of the user.

For the utilization of a timer 1 of that type there is preferably provided the following operating schematic:

For the input of the clock time there must be concurrently actuated at least two suitable ones of the four push-buttons 4, 5, 6 and 7. During the period of actuation, by means of the pulse generator which is operable through the turn-knob 8, there can be intruded the current clock time. The first push-button 4 serves, in connection with the pulse generator, for the input of a period, for example, for short-term measurement selectively with or without timer function. The second and third push buttons 5, 6, again in connection wirh the pulse generator, serve for the input of the switching-on term and the switching-off term, or, however, selectively for the switching-on term or the switching-off term through the one push-button which is in connection with the input of a switching-on period through the other push-button. The fourth push-button 7 serves for the switching-off of the timer operation (manual-input element).

Preferably, the timer 1 is positioned in "normal operation"; which signifies that no switching terms have been introduced, and is hereinafter designated as "manual-mode"; meaning, that the switching arrangement of the timer 1 has been bypassed or bridged and the appliance, preferably the cooking plate heating of a kitchen range, is connectable through a power switch directly with the current supply; in essence, manually actuable. In this manual-mode, the indicators 11, 12, 13 and 14 are preferably in the display condition c (continuously unilluminated).

When a switching term or even also a switched-on period is introduced through the second or third push-button 5, 6; but selectively also through the first push-button 4 by means of the pulse generator, then the timer automatically switches into an "auto-mode", in which the appliance is operated through the timer 1; in effect, is switched on only during a programmed switching time cycle. Designated hereby as the switching time cycle is the time interval between the switching-on and switching-off terms, or the switched-on period prior to or subsequent to the switching term. In the auto mode, the indicator 14 which is associated with the fourth push-button 7 (manual-input element) is in the indicating condition a (continuously illuminated), so as to provide an indication that the appliance has been automatically switched-on through the timer 1. Similarly found in the indicating condition (continuously illuminated) are the indicators 11, 12, 13 which are associated with the push-buttons 4, 5, 6, insofar as term data have been introduced by means of these push-buttons 4, 5, 6. When the introduced term data are incomplete when, for example, only one switching-on term but no switching-off term has been introduced, then the indicator which is associated with that particular push-button through which there was to be introducing the lacking input, is in the indicating condition b (blinking).

After working through the switching program, consisting of switching terms and/or switching period, the timer 1 moves into a "wait-mode" which is evidenced in that the indicator of 14 which is associated with the push-button 7 (manual-input element) is in the indicating position b (blinking). In the wait-mode, the appliance is completely separated from the current supply, and preferably the switching terms are also erased. This is evidenced in that the indicators 11, 12, 13 which are associated with the push buttons 4, 5 and 6 will assume the indicating condition c (continuously unilluminated).

For effecting the switching over from the wait-mode into the manual-mode there must then be actuated to push-button 7, which is indicated to the user in an understandable manner through the blinking indicator 14. After this switching over by hand into the manual mode, the appliance which is connected to the timer 1; for example, a heating for a cooking location, can be again switched on and off by hand.

Preferably, the push-button 7 (manual-input element) is so connected that the timer 1, upon an actuation in the auto-mode, is also switched into the manual-mode, whereupon there are erased all introduced switching terms. This, in particular, serves for the rapid erasing of erroneouly introduced switching terms.

Figure 2:
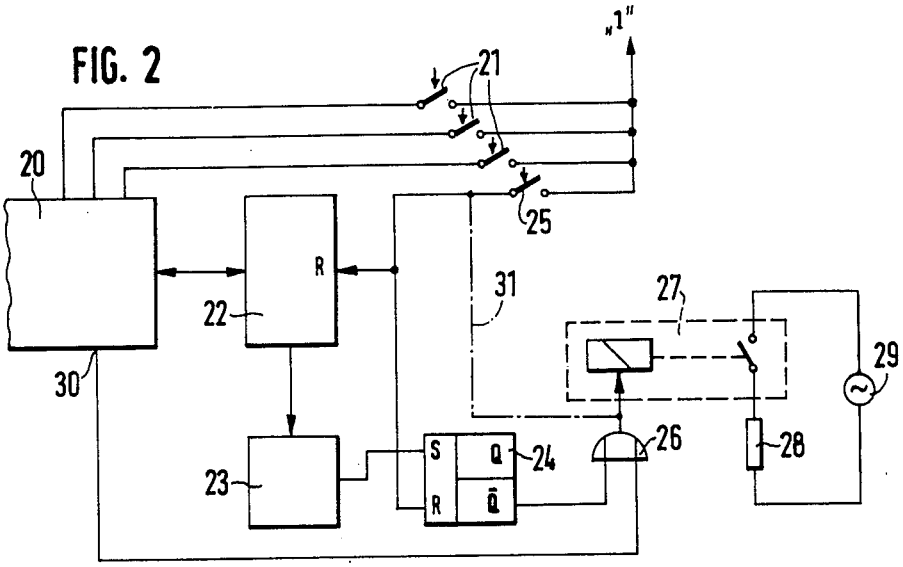
FIG. 2 is a circuit block diagram of a first embodiment of an input arrangement for the electronic timer.

Referring to FIG. 2 of the drawings, there is illustrated a circuit block diagram of an input arrangement for an electronic timer 1 with a control circuit 20 which contains the clock functions, and of which the terminal connections are only represented to the extent showing the interrelationship with the input arrangement.

The control circuit 20 is in connection with a plurality of switch elements 21, of which three are illustrated; these switch elements 21 belong to the push-buttons 4, 5, 6 pursuant to FIG. 1, respectively pulse generator, (with a turn-knob 8 as in FIG. 1) by means of which switching terms can be entered into a memory or storage 22 which is connected with the control circuit 2. The memory 22 is connected with a test circuit 23, for example, a comparator circuit, which compares the memory content with value "0", and upon non-coincidence, generates a switching signal (the memory or storage content "0" hereby signifies that no switching terms have been entered), by means of which there is set a flip-flop 24.

When the memory 22 contains a value which is not equal to "0", in essence, the flip-flop 24 is set, then the timer 1 is in the auto-mode. The return setting of the flip-flop 24 is effected through a manual-switch element 25. This return setting is made possible when the timer 1 is in the wait-mode and the content of the memory 22 is equal to "0". Hereby, it is a prerequisite that the content of the memory 22 is erased by the control circuit 20 after the working through of the stored switching terms. Preferably, the manual switch element 25 is additionally connected with a resetting input R of the memory 22 or, selectively, with a corresponding control input of the control circuit 20 which evidences the same function, so that upon actuation of the manual switch element 25, the stored switching terms are also erased. An actuation of the manual-switch element 25 is then also purposeful in the auto-mode, and here serves for the rapid erasing of incorrectly entered switching terms. In this embodiment, the switching terms need not be then necessarily erased by the control circuit 20 after the working through of the sequence.

An inverting output of the flip-flop 24 controls a switching relay 27, through an OR-gate 26, whose switching contacts are opened in the inactive condition. By means of the switching contacts of the switching relay 27 an appliance 28 is connectable to a current supply 29. At a set flip-flop 24; meaning, in the auto-mode and in the wait-mode, the appliance is disconnected from the current supply 29 as long as the control circuit 20 does not generate a signal at a switch output 30, which actuates the switching relay 27 through the second input of the OR-gate 26. The signal which is generated at the switch output 30 switches the switching relay 27 during the switching terms which are stored in the memory 21, 22, so that the appliance 28 is connected with the current supply 20 (auto-mode). When the flip-flop 24 is reset after working through of the stored switching terms (wait-mode) by means of the manual switch element 25 (in the manual-mode), then the switching relay 27 is continuously actuated through the inverting output of the flip-flop 24, and the appliance 28 is connected with the current supply 29.

The appliance 28 can hereby be manually operated by means of a switch arrangement which is built into the appliance 28.

As can be ascertained from the foregoing, in this embodiment the switching relay 27 is permanently switched into the manual mode; this, however, signifies that for fixed-installed timers, for example, for kitchen range timers, at a power outage or during disruptions of the control electronics of the timer, the appliance 28 can no longer be actuated. Consequently, within the context of the invention it is advantageous that the manual switch element 25 which, for example, is designed as a push-button, can be so constructed that it can be locked into the actuated condition, and thus the switching relay 27 can be actuated through an emergency control line 31 (illustrated in FIG. 2) directly from the manual-switch element 25. With the prerequisite that the voltage source which is connected to the manual-switch element 25 can be sufficiently loaded, such an "over-switching" of the output of the OR-gate 26 is possible within the context of a wired OR-junction. Through this measure, the appliance 28 can be further manually operated by depressing and latching of the manual-switch element 25 during an outage of the control electronics.

Figure 3:
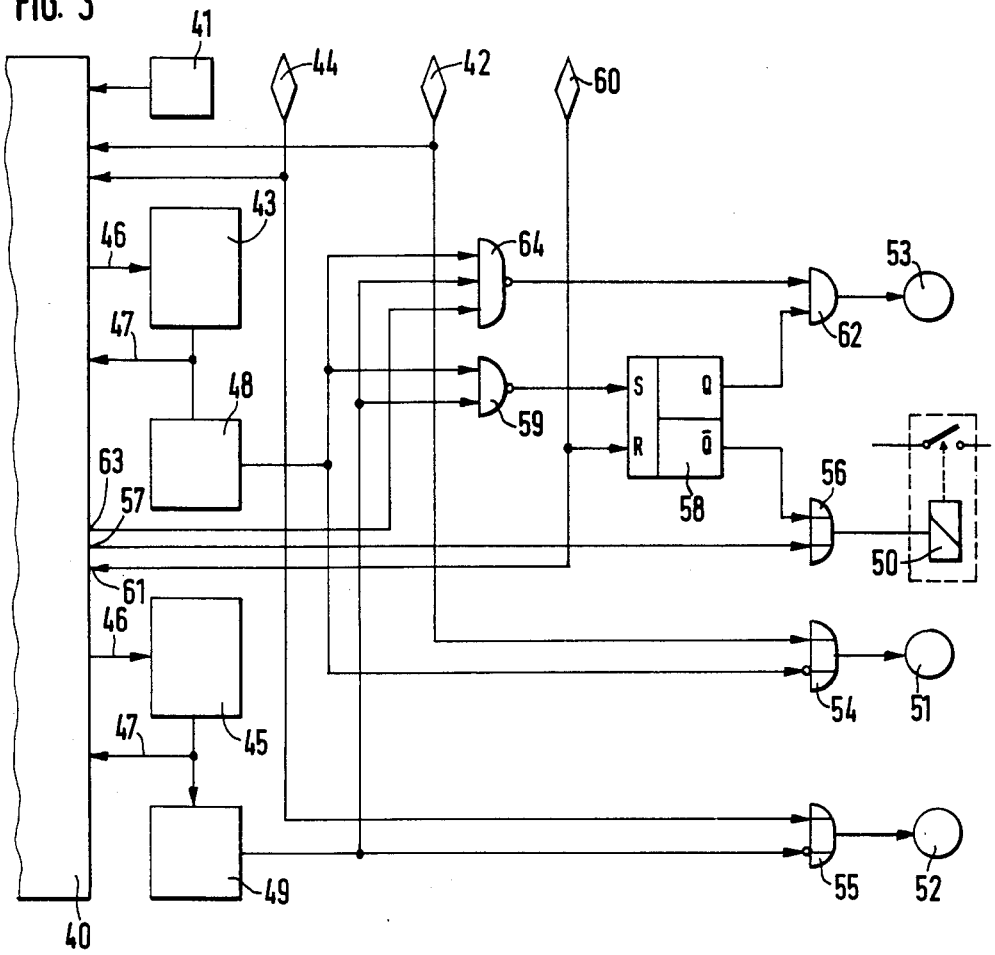
FIG. 3 is a circuit block diagram of a preferred embodiment of an input arrangement for the timer.

This additional measure can also be advantageously utilized in an equivalent manner in the following described, preferred embodiment as illustrated in FIG. 3 of the drawings.

In FIG. 3 a circuit schematic finally illustrates a preferred embodiment of an input arrangement wherein, as the switching terms, there are employed the "switching cycle duration" and the "switching cycle end".

For this purpose there is employed a control circuit 40, of which only the portion the terminal connector which are relevant to the input and memory are illustrated. The control circuit 40 is preferably actuated by a pulse generator 41 which delivers sequential pulses, which presently have associated therewith an information with regard to the setting direction, as well as over a duration push-button 42 through which the pulses generated by the pulse generator 41 are associated with an actuating period-memory 43, and an end push-button 44 by means of which the pulses generated by the pulse generator 41 are associated with an end-memory 45. Hereby, in the actuating period-memory 43 there is stored the switching term "switching cycle duration" and in the end-memory 45 the switching term "switching cycle end".

The actuating period-memory 43 and the end-memory 45 are actuated by the control circuit 40 through input connectors 46 and output connectors 47, after processing through, the stored data are erased, meaning, that a repetition of the switching cycle will not take place after the passage of, for example, 24 hours. The erasing of the stored data is hereby effected through resetting of the memories 43, 45 to zero. Additionally, the two memory storages 43, 45 are each connected with a test circuit 48, 49 which recognizes as to whether the memory 43, 45 is erased and, upon the presence of an erased memory 43, 45, will generate a switching signal in which actuates a gating logic. This gating logic controls a switching relay 50 which can switch-on and off an appliance (not shown), a period indicator 51 which illuminates with a depressed period push-button 42 or during a switched-on period which is stored in the switched on period memory 43, an end-indicator 52 which will illuminate a depressed end push-button 44 and at a switching-on end stored in the end-memory 45, as well as an automatic/manual indicator 53 which will illuminate in the auto-mode, in effect during the processing of a switching program, which will blink in the wait-mode, in effect after processing through the switching program and prior to the resetting into the manual-mode, and which when in the manual-mode will not illuminate, in effect when the appliance is operable independently of the timer.

Hereby, the period and end indicators 51, 52 are each respectively actuated through an OR-gate 54, 55 which join the inverted switching signal from the test circuits 48, 49 which are coupled with the respective memory storage 43, 45, and the input signal of the period or, respectively, end push-buttons 42, 44.

The switching relay 50 is actuated through an OR-gate 56 which joins the signal from a switching output 57 of the control circuit 49 which controls the relay in conformance with the program switching terms, and the inverted output signal of a flip-flop 58. The switching relay 50 is hereby so switched that the appliance (not shown) will be connected with the current supply at an actuated switching relay 50.

The flip-flop 58 is set through the inverted output signal of an AND-gate 59 which joins the output signals of the two test circuits 48, 49, meaning that the flip-flop 58 is set as soon as either the switched-on period memory 43 or also the end memory 45 contains a value which is unequal to 0 (auto-mode). When the switching terms which are present in the memory storages 43, 45 are processed down and erased, as described hereinabove, then the flip-flop 58 remains set; in effect, the switching relay 50 maintains the appliance in a switched-off condition. The resetting of the flip-flop 58, which is of the same significance as the switching over into the manual-mode, is effected with the aid of a manual push-button 60 which is connected with the resetting input of the flip-flop 58 and with a resetting input 61 of the control circuit 20. Through this resetting input 61 it is possible to provide for an erasing of the contents of the switched-on period memory 43 and the end memory 45. With the manual push-button 60 there can be thus, at first, be switched back the timer after processing through of the switching program from the wait-mode into the manual-mode and, for the second, there can be again rapidly erased an erroneously entered switching program.

The automatic/manual-indicator 53, which by means of its display condition illustrates the present mode of the timer, is actuated through a further AND-gate 62 which interengages the non-inverted output signal of the flip-flop 58 and an inverted blinking signal. The blinking signal consists of junction of a blinking pulse which is taken from a pulsing or multiplex output 63 of the control circuit 40 and the output signals of the two comparator circuits 48, 49 through a multiple AND-gate 64; meaning, the blinking signal is always generated when the two memories 43 and 45 are erased.

Since the actuation of the automatic/manual-indicator 53 is effected with the inverted blinking signal and (in the context of the junction) with the non-inverted output signal of the flip-flop 58, the indicator 53 can only continuously illuminate when the flip-flop 58 is set; in effect, at least one of the memory storages 43, 45 contains term data (auto-mode). The indicator 53 can then only blink when the flip-flop 58 in set; however the memory storages 43, 45 are erased (wait-mode). When the flip-flop 58 is reset (manual-mode), the indicator 53 remains dark.

Within the context of the invention it is also possible that the previously detailed functions of the control circuit, the memory with test circuits, as well as the gating logic can be effectuated by suitably programmed microcomputer.

What is claimed is:

1. In an electronic timer, such as a kitchen range timer, including a control circuit, a display field, input elements which enter at least one switching term which provided a timing program, and switching means which selectively connects an appliance operable through said timer directly to a current supply; the improvement comprising means which switches automatically said control circuit from a manual mode into an auto-mode through the input of one complete switching term, in said auto mode the appliance operates exclusively through said timer in accordance with the timing program and cannot be manually operated through the electronic timer without erasing the timing program, and for switching said control circuit into a wait-mode after processing through the at least one switching term, and simultaneously switching on a wait mode optical indicator and disconnecting the appliance from the current supply, and manual input means for switching the control circuit from the wait-mode into the manual mode, in which mode the appliance is directly connected to the current supply.

2. Electronic timer as claimed in claim 1, wherein the said at least one switching term is erased upon reaching of the wait-mode.

3. Electronic timer as claimed in claim 1, wherein the at least one switching term is erased through the actuation of the manual input means while the control circuit is the auto-mode and the control circuit is switched into the manual-mode.

4. Electronic timer as claimed in claim 1, wherein optically visible indicators are associated with at least said manual input means, said indicators being capable of assuming at least three different display conditions.

5. Electronic timer as claimed in claim 4, wherein the indicator associated with the manual input means is a portion of the display field and provides for the following display conditions:

Auto-mode: continuously illuminated,

Wait-mode: blinking,

Manual-mode: continuously unilluminated.

* * * * *

UNITED STATES PATENT AND TRADEMARK OFFICE

CERTIFICATE OF CORRECTION

PATENT NO. : 4,749,874

DATED : June 7, 1988

INVENTOR(S) : Alfred Meisner, et al.

It is certified that error appears in the above-identified patent and that said Letters Patent is hereby corrected as shown below:

Column 3, line 23: "wirh" should read as --with--

Column 7, line 17: "in" should read as --is--

Column 7, line 30, Claim 1: "provided" should read as --provides--

Signed and Sealed this

Twentieth Day of June, 1989

*Attest:*

*Attesting Officer*

DONALD J. QUIGG

*Commissioner of Patents and Trademarks*